United States Patent [19]

Ueno et al.

[11] 4,377,785

[45] Mar. 22, 1983

[54] DEVICE FOR DIAGNOSING IGNITION SYSTEM FOR USE IN INTERNAL COMBUSTION ENGINE

[75] Inventors: Yoshiki Ueno, Aichi; Takakazu Kawabata, Toyota; Tadashi Hattori; Kazuhiko Miura, both of Okazaki, all of Japan

[73] Assignees: Nippon Soken, Inc.; Toyota Jidosha Kogyo Kabushiki Kaisha, both of Nishio, Japan

[21] Appl. No.: 166,094

[22] Filed: Jul. 2, 1980

[30] Foreign Application Priority Data

| | | | |
|---|---|---|---|
| Jul. 6, 1979 | [JP] | Japan | 54-86088 |
| Jul. 10, 1979 | [JP] | Japan | 54-87883 |
| Jul. 20, 1979 | [JP] | Japan | 54-92752 |

[51] Int. Cl.[3] ..... F02P 17/00

[52] U.S. Cl. ..... 324/378; 324/60 C; 324/388; 324/390

[58] Field of Search ..... 324/378, 390, 388, 399, 324/60 C

[56] References Cited

U.S. PATENT DOCUMENTS

| | | | |
|---|---|---|---|
| 3,959,725 | 5/1976 | Capek | 324/388 X |
| 3,986,108 | 10/1976 | Thomas | 324/60 C |
| 4,068,165 | 1/1978 | Labinsky et al. | 324/399 X |
| 4,123,674 | 10/1978 | Cominskey et al. | 324/388 X |

*Primary Examiner*—Stanley T. Krawczewicz

*Attorney, Agent, or Firm*—Cushman, Darby & Cushman

[57] ABSTRACT

An ignition system for internal combustion engine, which controls the ignition coil primary current according to the magnitude of the floating capacitance in the secondary side wiring section of the ignition coil, by determining the floating capacitance from the negative slope of rising of the secondary voltage produced in the ignition coil in response to the cutoff of the primary current and the primary cutoff current value, the slope being determined by measuring the period T until the secondary voltage reaches a predetermined voltage value. When the floating capacitance is increased, the primary cutoff current value is increased to increase the coil energy so as to increase the secondary voltage generated in the ignition coil for preventing the generation of a miss-spark.

8 Claims, 29 Drawing Figures

DEVICE FOR DIAGNOSING IGNITION SYSTEM FOR USE IN INTERNAL COMBUSTION ENGINE

This invention relates to ignition systems for internal combustion engines and, more particularly, to a system in which the floating capacitance which has great influence upon the transmission of a high voltage is measured. Also, the invention relates to a system, in which when the high voltage transmission loss is increased so that miss-sparks are likely to be generated the coil energy is increased to prevent the generation of miss-sparks.

In the usual ignition system for an internal combustion engine, a high voltage produced from an ignition coil is transmitted through a high tension line and a distributor to each ignition plug. Usually, however, the output impedance of the ignition coil is comparatively high, and also the high tension line code lies in the close proximity of the engine body. Therefore, there always exists a distributed electrostatic capacitance or so-called floating capacitance in the wiring section of the secondary of the ignition coil. This floating capacitance increases when water or saline water is attached to the high tension code. In such a case, the high voltage to be impressed upon the ignition plug electrode is reduced compared to the voltage produced in the ignition coil. FIG. 1 shows this relationship. In the Figure, the ordinate is taken for the maximum value E of the generated voltage, and the abscissa is taken for the floating capacitance C. Plots a and b represent characteristics for respective ignition coil primary cutoff current values of 5.7 and 3.8 A. In the graph, 0 pF of the floating capacitance is shown in the abscissa for the sake of comparison although actually there exists some floating capacitance. The voltage generated in the ignition coil is readily reduced with the increase of the floating capacitance, while increasingly high voltage has been demanded as the ignition coil secondary voltage for such purpose as the exhaust gas recirculation (EGR) to cope with exhaust gas problems. Thus, there is a trend for increasing probability of the miss-spark generation, posing problems in the engine performance.

To solve these problems, the development of ignition coils and high tension line codes, which is highly reliable and less likely to give rise to the reduction of the high voltage, is called for. Also, for diagnosing the ignition system, ignition system diagnosing means, particularly floating capacitance measuring means, are necessary.

Although the measurement of the floating capacitance can be made with a commercially available electrostatic capacitance meter, extreme difficulties are involved in the measurement in this case since the ignition coil and each ignition plug are normally separated from each other by the distributor and also since a high voltage is impressed. Also, it is almost impossible to record the condition of the system during actual running.

To overcome the above difficulties, the invention is predicated in the fact that the secondary high voltage generated in the ignition coil varies with the increase of the floating capacitance, and according to the invention the floating capacitance involved in the ignition system is measured by measuring the ignition coil voltage. When the floating capacitance as shown by a broken curve in FIG. 2 is increased, the ignition coil secondary voltage as shown by a dashed curve in FIG. 2 is changed such that its peak value and also its period are increased. The floating capacitance can be measured by constantly measuring the peak value $V_{max}$ or the period $T_0$. Usually, however, with a spark discharge caused in the ignition plug electrode section the secondary voltage is reduced as shown by a solid curve in FIG. 2, so that neither $V_{max}$ or $T_0$ can be directly measured.

According to the invention, the floating capacitance is measured by determining the slope of a negatively rising portion of the secondary voltage waveform. This slope is found to vary with the ignition coil energy for the same floating capacitance, so that it is compensated for the coil energy. The coil energy is usually given as $$\tfrac{1}{2}L_1 \cdot I_{off}^2 \times \eta$$

where $L_1$ is the primary coil inductance of the ignition coil, $\eta$ is the efficiency of energy transfer from the primary to the secondary of the ignition coil, the $I_{off}$ is the primary cutoff current in the ignition coil. Assuming $L_1$ and $\eta$ to be constant, $I_{off}$ can be taken as the coil energy. FIG. 3 shows a relationship among the rising period T, which is required for the secondary voltage to rise from zero to a constant voltage $V_a$, the primary cutoff current $I_{off}$ and the floating capacitance. In the Figure, the ordinate is taken for the rising period T required for reaching $V_a = -5$ kV, and the abscissa is taken for the primary cutoff current $I_{off}$. Plots a to d represent characteristics for respective floating capacitance values of 0, 50, 100 and 150 pF. It will be seen from FIG. 3 that the floating capacitance can be determined by measuring the rising period T and the primary cutoff current $I_{off}$ and finding a point correlating the two measured values.

An object of the invention is to provide an ignition system for an internal combustion engine, which can estimate the reduction of the ignition coil secondary voltage by the aforementioned method.

Another object of the invention is to provide an ignition system for an internal combustion engine, which always detects the floating capacitance and, when the floating capacitance is increased, makes the energization period of the ignition coil primary longer to increase the coil energy so as to increase the secondary voltage for preventing the generation of a miss-spark.

A further object of the invention is to provide an ignition system for an internal combustion engine, which always detects the floating capacitance and, when the floating capacitance is increased, increases the primary cut-off current to increase the coil energy so as to increase the secondary voltage for preventing the generation of a miss-spark.

According to the invention, according to which the floating capacitance in the ignition system is measured by determining the slope of rising of the ignition coil secondary voltage, the reduction of the secondary voltage can be estimated from the result of the measurement, so that it is possible to effect the diagnosis as to whether or not the layout of the ignition system components such as ignition coil, distributor, high tension codes and ignition plugs is satisfactory and also as to what effects the changes of the environmental conditions have upon the ignition coil voltage.

Further, since the system according to the invention has a simple construction, it can be mounted in a vehicle to permit the diagnosis of the ignition system during the running of the vehicle.

Furthermore, since the system according to the invention measures the floating capacitance and makes the energization period of the primary coil longer or increases the primary cutoff current when the floating capacitance is increased, it is possible to reliably prevent the generation of a miss-spark with the ignition coil voltage increased by increasing the coil energy at the time when the floating capacitance is increased.

These and other objects and advantages of the invention will become apparent by referring to the following description and accompanying drawings wherein.

Figure 4:
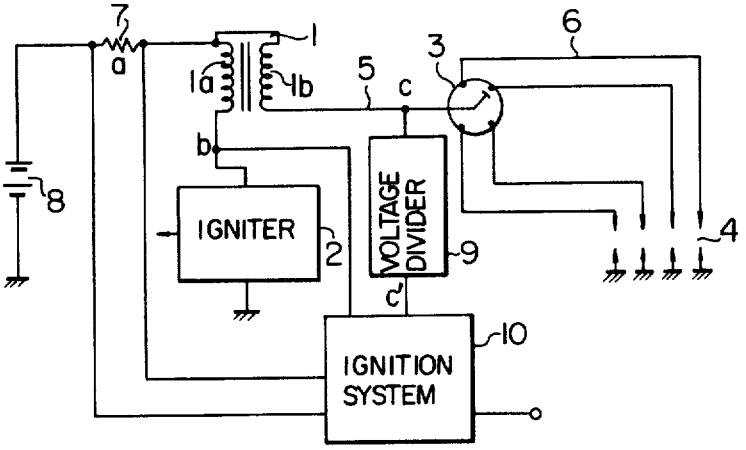
FIG. 4 is a schematic showing the construction of a first embodiment of the ignition system for an internal combustion engine according to the invention.

Now, preferred embodiments of the invention will be described with reference to the accompanying drawings. FIG. 4 shows an embodiment of the ignition system for an internal combustion engine according to the invention. Designated at 1 is an ignition coil, and at 2 an igniter for controlling the energization and de-energization of a primary coil 1*a* of the ignition coil. The igniter 2 is connected to an ignition timing control means not shown. Designated at 3 is a distributor, and at 4 ignition plugs. A high voltage produced across a secondary coil 1*b* of the ignition coil 1 is applied through a high tension line 5 to the distributor 3 and thence through high tension lines 6 to ignition plugs 4. The floating capacitance is the capacitance component present in this high voltage transmission system. Designated at 7 is an external resistor connected in series with the primary coil 1*a* of the ignition coil 1, and at 8 a battery. Designated at 9 is a voltage divider for detecting the secondary high voltage across the ignition coil 1 through voltage division, and at 10 an ignition system diagnosing unit according to the invention.

Figure 5:
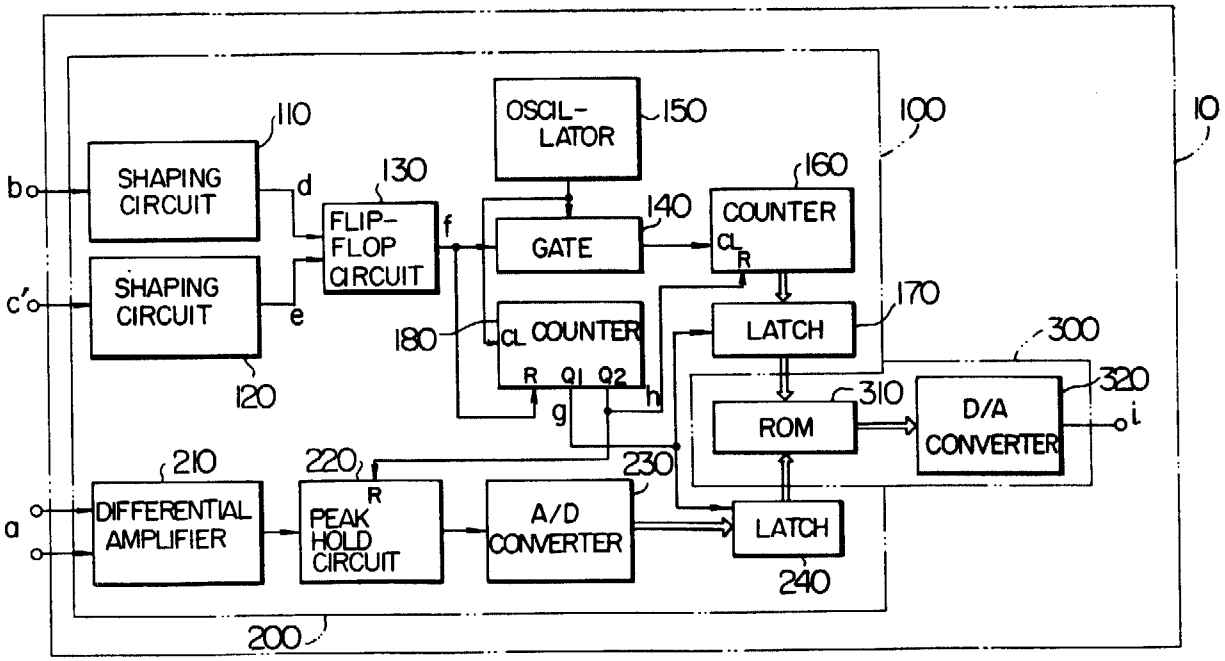
FIG. 5 is a block diagram showing a specific example of a component part of the embodiment of FIG. 4.
Figure 6:
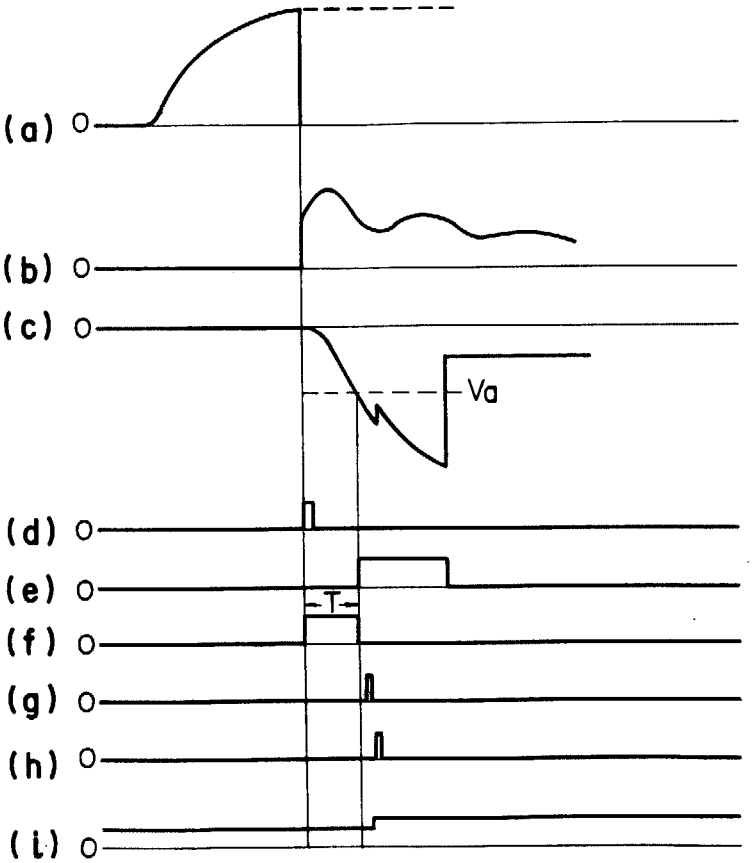
FIG. 6 is a time chart illustrating the operation of the circuit of FIG. 5.

An example of the ignition system diagnosing unit 10 will now be described in detail. FIG. 5 is its block diagram, and FIG. 6 is a time chart illustrating waveforms appearing at various parts of it. Designated at 100 is a floating capacitance detecting section. It includes a shaping circuit 110 with an input terminal thereof connected to the point b in FIG. 4, i.e., the juncture between the ignition coil 1 and igniter 2. The waveform appearing at the point b is as shown in (b) in FIG. 6. The shaping circuit 110 shapes this waveform into a pulse signal having a predetermined duration as shown in (d) in FIG. 6. The detecting section includes another shaping circuit 120 with an input terminal c' thereof connected to the point c' in FIG. 4. The point c' is connected through the voltage divider 9 to the high tension line 5. The voltage divider 9 is of a well-known type using a resistor and a capacitor and dividing the input voltage to 1/1,000. The waveform appearing at the point c' is as shown in (c) in FIG. 6. The shaping circuit 120 includes a comparator for comparing this waveform with a constant voltage $V_a$ as shown by a dashed line in (c) in FIG. 6 and producing an output at a level "1" when the value is surpassed, and it produces an output as shown in (e) in FIG. 6. A flip-flop circuit 130, which consists of a well-known R-S flip-flop, receives the outputs of both the shaping circuits 110 and 120 and produces a pulse as shown in (f) in FIG. 6. The duration T of this pulse represents the slope of rising of the secondary voltage generated in the ignition coil 1. A gate 140 passes clock pulses from an oscillator 150 to a counter 160 for a period corresponding to the duration of the output pulse from the flip-flop circuit 130, thus measuring the period T. A counter 180 produces pulses spaced apart in time (pulses in (g) and (h) in FIG. 6) for causing a latch 170 to take out the result of the count from the counter 160 and subsequently resetting the counter 160. More particularly, the result of the count of the counter 160 is temporarily stored in the latch 170 under the control of the pulse in (g) in FIG. 6, and the counter 160 is subsequently reset under the control of the pulse in (h) in FIG. 6. The measurement value T temporarily stored in the latch 170 is then supplied to a memory section 300. Designated at 200 is a primary cutoff current measuring circuit. It includes a differential amplifier 210 which detects the primary current by detecting the potential difference between the opposite ends of the external resistor 7. The detected waveform is as shown in (a) in FIG. 6. The peak of this waveform is held by a peak hold circuit 220 as shown by a dashed line in (a) in FIG. 6, and is converted by an analog-to-digital (A/D) converter 230 into a corresponding digital value. This digital signal is taken out by a latch 240 at the timing of the afore-mentioned latch signal shown in (g) in FIG. 6 to be supplied to the memory section 300.

Figure 3:
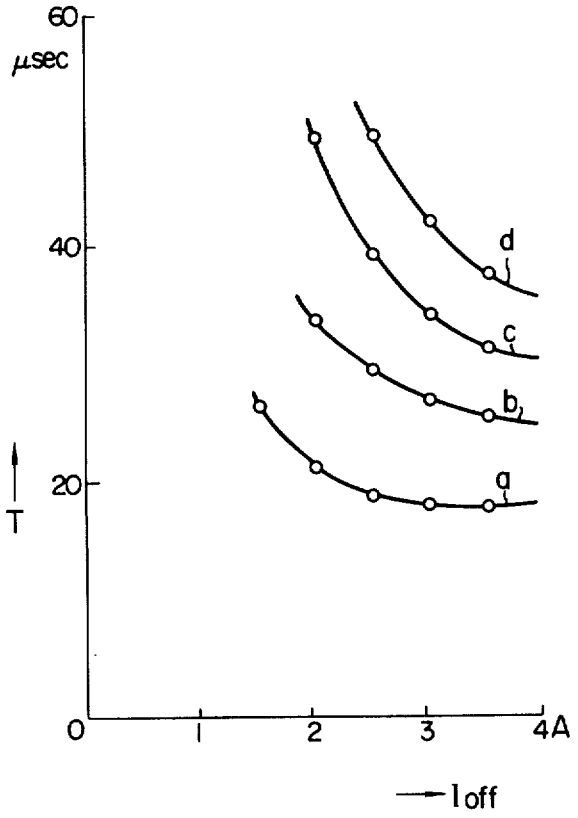
FIG. 3 is a graph showing a relationship among the primary cutoff current, the period until the secondary voltage reaches $V_a$ and the floating capacitance.

The memory section 300 includes a read only memory (ROM) 310 and a digital-to-analog (D/A) converter 320. The ROM 310 receives as its input the output of the latch 170 in the floating capacitance detecting circuit 100 and the output of the latch 240 in the primary cutoff current detecting circuit 200. These two data respectively represent the rising period T and the primary cutoff current $I_{off}$, and the ROM 310 produces a value representing the floating capacitance determined from the two input values. In the ROM 310, data as shown in FIG. 3 (representing the floating capacitance correlating the rising period T and primary cutoff current $I_{off}$) are memorized. The D/A converter 320 converts the digital value produced from the ROM 310 into an analog voltage, that is, it produces a voltage value as shown in (i) in FIG. 6 which represents the magnitude of the floating capacitance.

A second embodiment of the invention will now be described. While in the preceding first embodiment the period T from the rising of the primary voltage till the reaching of a constant voltage $V_2$ is measured for determining the slope of rising of the secondary voltage, in the second embodiment the slope is determined by measuring the secondary voltage a predetermined period after the rising of the primary voltage.

Figure 7:
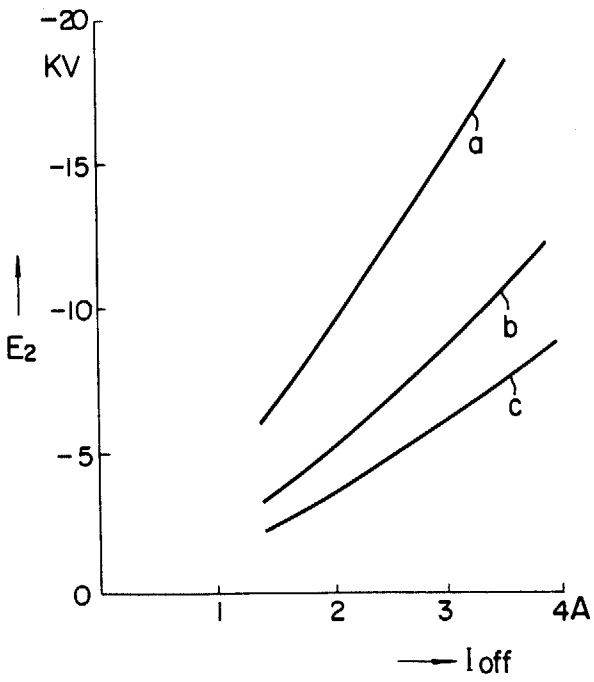
FIG. 7 is a graph showing a relationship among the primary cutoff current, the secondary voltage at a predetermined instant and the floating capacitance.

FIG. 7 shows a graph, in which the secondary voltage $E_2$ 50 μsec. after the rising of the primary voltage is plotted. Plots a, b and c represent characteristics for respective floating capacitance values of 0, 50 and 100 pF. As is shown, the secondary voltage $E_2$ increases with increase of the primary cutoff current $I_{off}$ while it decreases with increase of the floating capacitance. It will be seen from FIG. 7 that the floating capacitance can be determined from the secondary voltage $E_2$ and primary cutoff current $I_{off}$ if these values are obtained. The secondary voltage is actually negatively as high as several ten kV, but one-thousandth of its value is measured by virtue of the fact the afore-mentioned voltage divider 9 dividing a high voltage is used.

Figure 8:
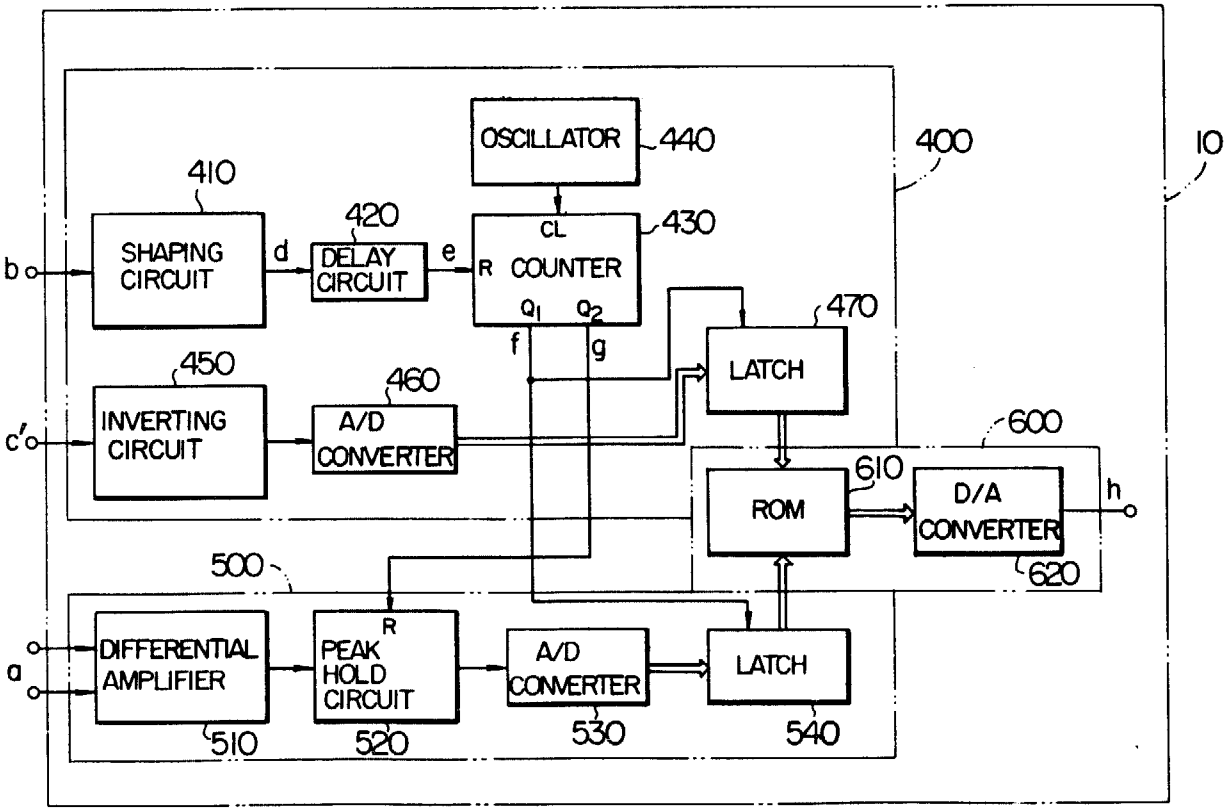
FIG. 8 is a block diagram showing a second example of the component part of the embodiment of FIG. 4.

FIG. 8 shows a second example of the ignition system diagnosing unit, which is generally designated at 10. Designated at 400 is a rising slope measuring circuit. It includes a shaping circuit 410 with the input terminal thereof connected to the point b in FIG. 4, i.e., the juncture between the ignition coil 1 and igniter 2. At this point b a waveform as shown in (b) in FIG. 9 appears. The shaping circuit 410 converts this waveform into a pulse as shown in (d) in FIG. 9. A delay circuit 420 receives the output pulse of the shaping circuit 410 as trigger pulse to produce a pulse having a duration T' as shown in (e) in FIG. 9. A counter 430 receives the output pulse of the delay circuit 420 as reset input and starts counting of clock pulses from an oscillator 440 after the falling of this pulse. It produces as its outputs $Q_1$ and $Q_2$ pulses spaced apart in time as shown in (f) and (g) in FIG. 9. The rising slope measuring circuit 400 further includes an inverting circuit 450, which receives as its input the output of the voltage divider 9 as shown in (c) in FIG. 9. This input is obtained by dividing the secondary voltage to 1/1000. Since the secondary voltage is a negative voltage, the inverting circuit 450 inverts the divided voltage input to a positive one. An A/D converter 460 converts the output of the inverting circuit 450 into a digital value. The output of the A/D converter 460 is temporarily stored in a latch 470 at a timing as shown in (f) in FIG. 9 before being supplied to a memory section 600.

Designated at 500 is a primary cutoff current measuring circuit. It includes a differential amplifier 510 for detecting the primary current by measuring the potential difference between the opposite terminals of the external resistor 7 in series with the ignition coil 1. The detected waveform is as shown by a solid line in (a) in FIG. 9. A peak hold circuit 520 holds the peak of the primary current waveform as shown by a dashed line in (a) in FIG. 9, and an A/D converter 530 converts this value into a digital one. This digital value is taken out by a latch 540 at the timing of the latch signal shown in (f) in FIG. 9 to be supplied to the memory section 600.

The memory section 600 includes a ROM 610 and a D/A converter 620. The ROM 610 receives as its input the output of the latch 470 in the rising slope measuring circuit 400 and the output of the latch 540 in the primary cutoff current measuring circuit 500. These two data respectively represent the secondary voltage $E_2$ and primary cutoff current $I_{off}$, and the ROM 610 produces the floating capacitance value determined from these two values. In the ROM 610, data regarding the one-thousandth of the secondary voltage value are memorized.

Figure 9:
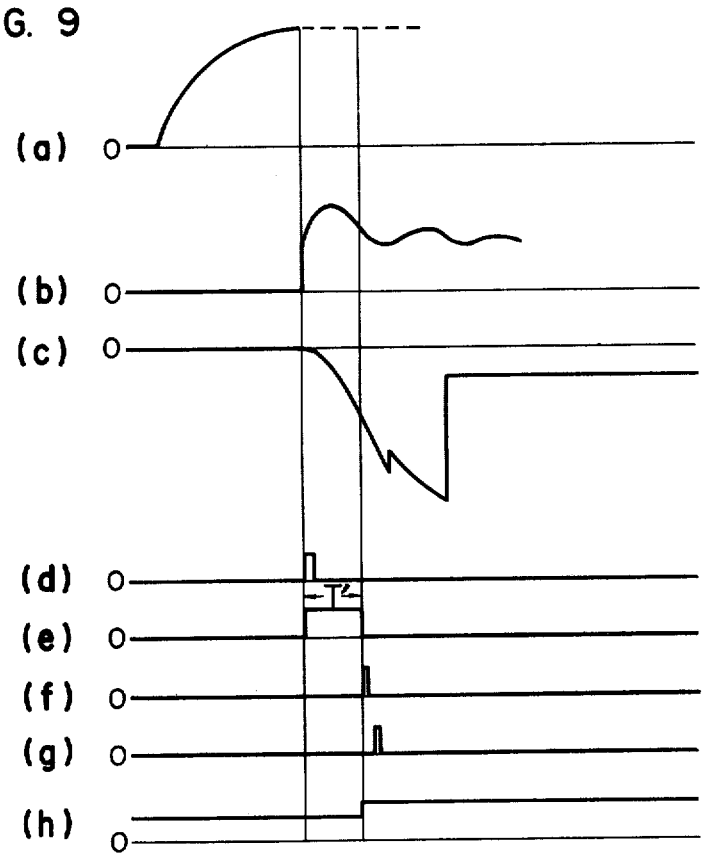
FIG. 9 is a time chart illustrating the operation of the circuit of FIG. 8.

The D/A converter 620 converts the output digital value of the ROM 610 into an analog voltage, that is, it produces a voltage value as shown in (h) in FIG. 9 corresponding to the magnitude of floating capacitance.

While in the preceding first and second examples respectively shown in FIGS. 5 and 8 the slope has been measured respectively by determining the time elapsed until the reaching of a predetermined voltage and the secondary voltage after a predetermined period of time, in a third example the slope is determined from the time elapsed until the breakdown takes place and the breakdown voltage. As a means for determining the floating capacitance by this slope determination method, there is a map method, which makes use of three parameters, namely the cutoff current, time until the break takes place and breakdown voltage. Also, there is another method, in which an approximation to the secondary voltage is obtained by solving differential equations set up under the assumption of an equivalent circuit of the ignition system, and a formula for calculating the floating capacitance is derived to determine the floating capacitance from this formula. With the calculation system based on this formula, a formula for calculating the generated secondary voltage (i.e., the maximum value of the open waveform where the breakdown does not take place) can also be derived from the approximation formula for the secondary voltage, and the generated secondary voltage can be determined. The latter calculation system will now be described.

Figure 10:
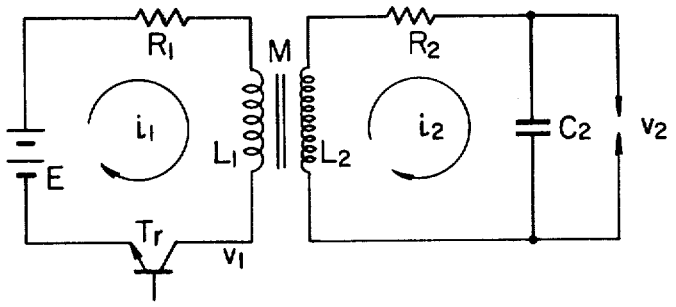
FIG. 10 is a block diagram showing an equivalent circuit of the ignition system.

FIG. 10 shows an equivalent circuit of the ignition system. Labeled E is the battery, $R_1$ the sum of the external resistance and the resistance of the coil primary, $L_1$ the inductance of the coil primary, Tr the last stage power transistor in the igniter, $R_2$ the resistance of the coil secondary, $L_2$ the inductance of the coil secondary, $C_2$ the sum of the capacitance of the coil secondary and the floating capacitance, M the mutual inductance of the coil, $i_1$ the primary current, $i_2$ the secondary current, $v_1$ the primary voltage, and $v_2$ the secondary voltage. From FIG. 10, there are set up differential equations:

$$R_1 i_1 + L_1 \frac{di_1}{dt} + M \frac{di_2}{dt} + v_1 = E$$

$$R_2 i_2 + L_2 \frac{di_2}{dt} + M \frac{di_1}{dt} + v_2 = O$$

$$v_2 = \frac{1}{c_2} \int i_2 dt$$

There is taken several ten μsec. before the primary current is cut off by the last stage power transistor in the igniter. Under the consideration of this cutoff time $T_s$ of the transistor, the primary current $i_1$ is assumed to be $$i_1 = \frac{I_{off}}{2}\left(1 + \cos\frac{\pi t}{T_s}\right) \text{ for } 0 < t < T_s \text{ and } i_1 = 0 \text{ for } T_s < t.$$

(It is also possible to linearly approximate $i_1$ to be $$i_1 = I_{off} \cdot \frac{T_s - t}{T_s} \text{ for } 0 < t < T_s \text{ and } i_1 = 0 \text{ for } T_s < t).$$

Then, by solving the above differential equations under this assumption we have, for $0<t<T_s$, $$v_2 = \frac{I_{off}}{2} \cdot k \cdot \sqrt{\frac{L_1}{C_2}} \left\{ \frac{T_s}{\pi} \sqrt{\frac{1}{L_2C_2}} \sin\frac{\pi t}{T_s} - \sin\frac{t}{\sqrt{L_2C_2}} \right\}$$

and for $T_s<t$, $$v_2 = \frac{I_{off}}{2} \cdot k \cdot \sqrt{\frac{L_1}{C_2}} \left\{ \sin\frac{t}{\sqrt{L_2C_2}} + \sin\frac{t - T_s}{\sqrt{L_2C_2}} \right\}$$

where k is the coefficient of coupling of the coil, i.e., $$k^2 = \frac{M^2}{L_1L_2}$$

Figure 13:
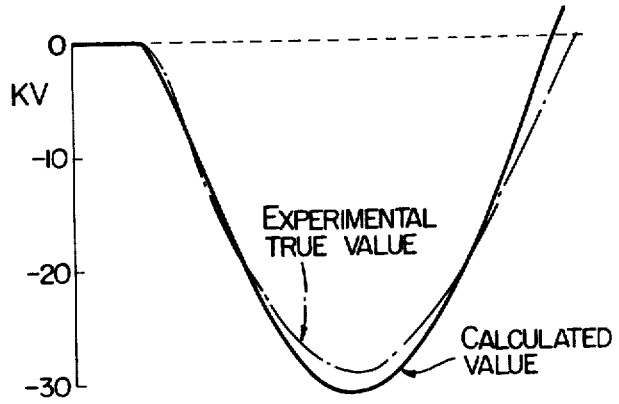
FIG. 13 is a graph showing result of operation by the approximation formula of the secondary voltage used in the third example of FIG. 11 and the true value of the secondary voltage for comprison.

FIG. 13 compares the experimental true value and calculated value of the secondary voltage $v_2$. These two values coincide well in a region from the rising of the secondary voltage till the reaching of the maximum value of the secondary voltage, in which the break takes place. Denoting the floating capacitance by C* and the generated secondary voltage by $V_G$, we have $$C^* = \frac{T^2 - TT_s + T_s^2}{3L_2} \div \left\{ 1 - \sqrt{1 - \frac{4V_B(T^2 - TT_s + T_s^2)}{3I_{off}k\sqrt{L_1L_2}\,(2T - T_s)}} \right\} - C_{L2}$$

$$V_G = \frac{I_{off}k}{\sqrt{2}} \sqrt{\frac{L_1}{C_2}} \sqrt{1 + \cos\frac{T}{\sqrt{L_2C_2}}}$$

where $C_{L2}$ is the capacitance of the coil secondary, T is the time until the break takes place, and $V_B$ is the breakdown voltage. It is possible to compensate $V_B$ in the above equations for the energy loss due to the discharge in the distributor, and by so doing the accuracy will be further improved.

Figure 11:
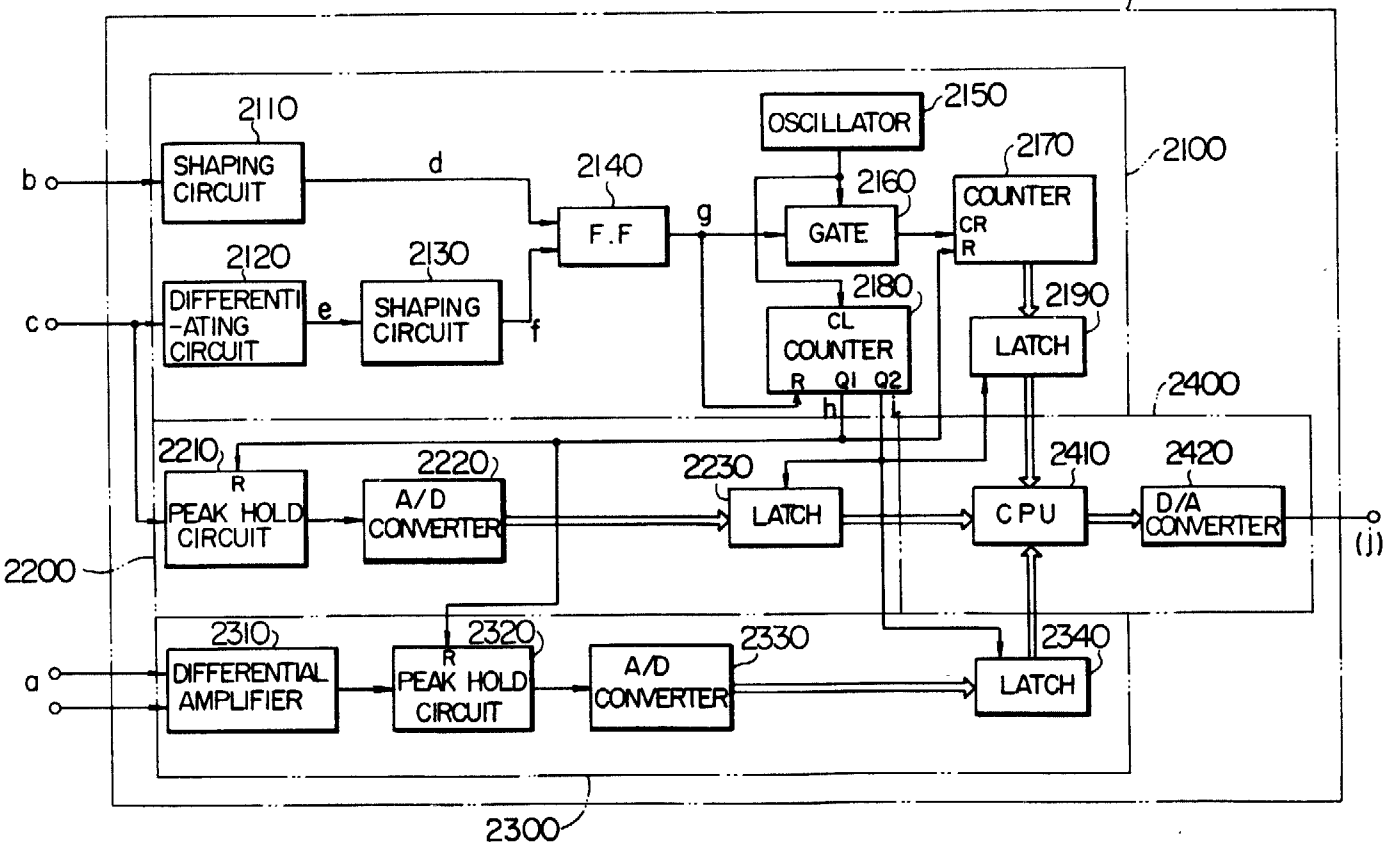
FIG. 11 is a block diagram showing a third example of the component part of the embodiment of FIG. 4.
Figure 12:
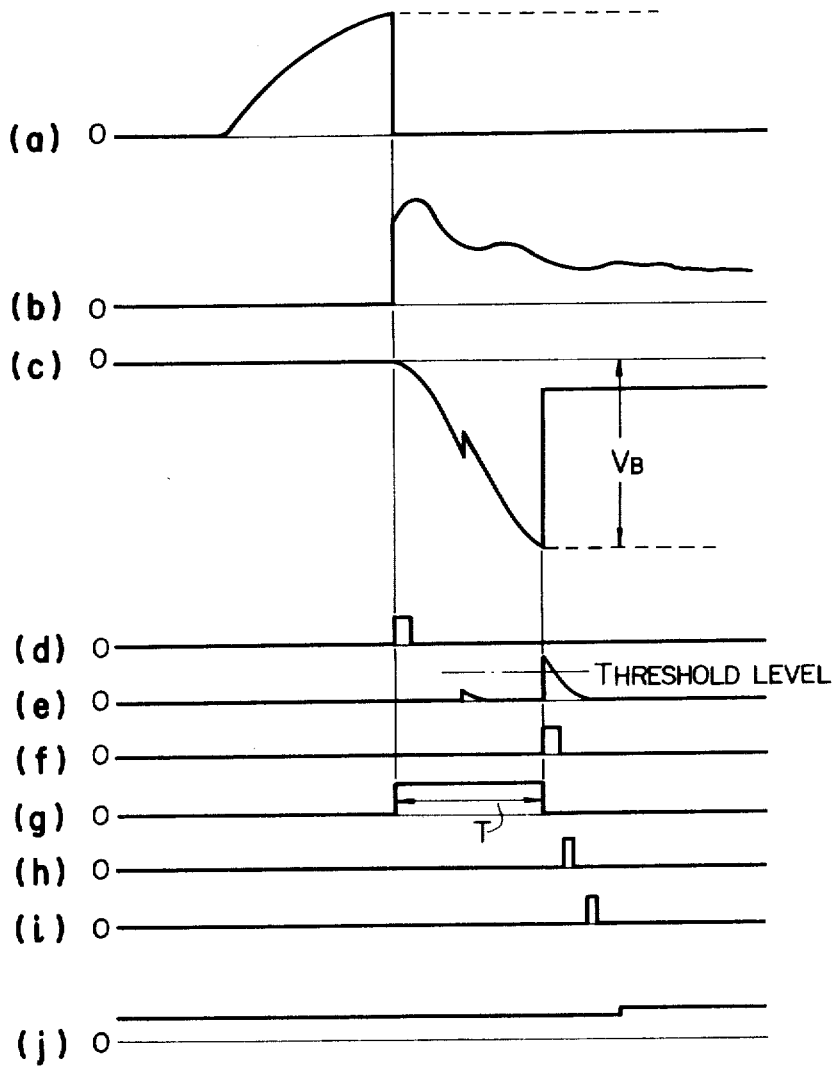
FIG. 12 is a time chart illustrating the operation of the circuit of FIG. 11.

FIG. 11 shows the third example of the ignition system diagnosing unit, which is generally designated at 10. Designated at 2100 is a time measuring circuit for measuring the time from the rising of the secondary voltage until the breakdown takes place. It includes a shaping circuit 2110 with an input terminal b thereof connected to the point b in FIG. 4. The waveform appearing at this input terminal is as shown in (b) in FIG. 12. The shaping circuit 2110 shapes this waveform into a pulse as shown in (d) in FIG. 12. The time measuring circuit also includes a differentiating circuit 2120 with an input terminal c' thereof connected to the point c in FIG. 4. The circuit 2120 differentiates a waveform as shown in (c) in FIG. 12 to produce a waveform as shown in (e). Its output is coupled to a shaping circuit 2130, in which a suitable threshold level is provided so that it does not detect the discharge in the distributor but detects only the discharge in the plug section to produce a waveform as shown in (f) in FIG. 12. A flip-flop circuit 2140 produces from the waveforms (d) and (f) in FIG. 12 a waveform representing the period of time T until the break takes place as shown in (g). A gate 2160 passes clock pulses from an oscillator 2150 to a counter 2170 for a period of time corresponding to the duration of the output pulse of the flip-flop circuit 2140, and thus it measures the time T. A counter 2180 produces pulses spaced apart in time (i.e., pulses as shown in (i) and (h) in FIG. 12) for transferring the result of the counter 2170 to a latch 2190 and subsequently resetting the counter 2170. More particularly, the result of the counter 2170 is transferred to and temporarily memorized in the latch 2190 under the control of the pulse (i), and the counter 2170 is subsequently reset under the control of the pulse (h). The measurement value T temporarily stored in the latch 2190 is supplied to an arithmetic section 2400.

Designated at 2200 is a breakdown voltage measuring circuit. Here, a peak hold circuit 2310 holds the peak of the secondary voltage waveform (c) in FIG. 12. It holds the peak of the waveform as shown by a dashed line in (c) in FIG. 12, and an A/D converter 2320 converts this value into a corresponding digital value, which is taken out by the latch 2330 at the timing of the latch signal (h) shown in FIG. 12 to be supplied to the arithmetic section 2400.

Designated at 2300 is a primary cutoff current measuring circuit. Here, a differential amplifier 2310 detects the primary current by measuring the potential difference between the opposite terminals of the external resistor 7 shown in FIG. 4. A peak hold circuit 2320 holds the waveform of its input, as shown by a solid line in (a) in FIG. 12, in a manner as shown by a dashed line, and an A/D converter 2330 converts this value into a digital value. A latch circuit 2340 supplies this digital value to the arithmetic section 2400 at the timing as shown in (h) in FIG. 12.

The arithmetic section 2400 includes a central processing unit (CPU) 2410 and a D/A converter 2420. In the CPU 2410, the values in the latches 2190, 2230 and 2340 are taken out, and the floating capacitance and generated secondary voltage are calculated with these values substituted into the afore-mentioned formulas for obtaining the floating capacitance and generated secondary voltage.

Figure 14:
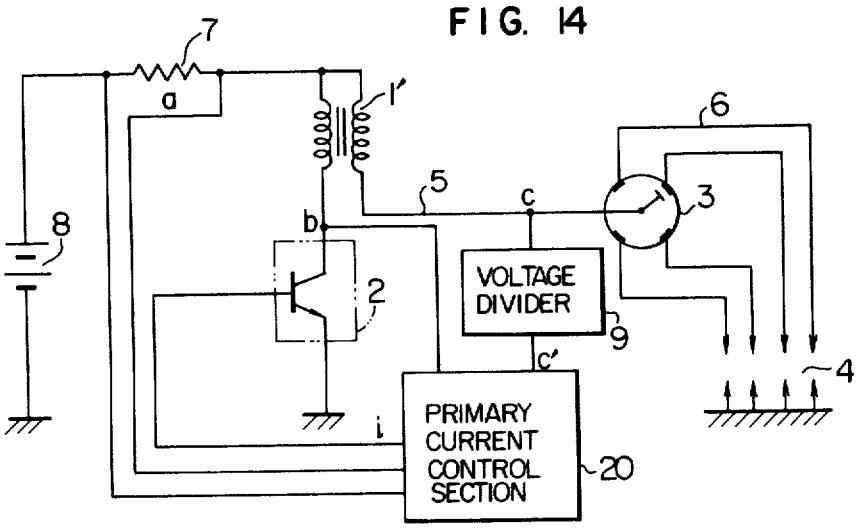
FIG. 14 is a schematic showing a second embodiment of the ignition system for an internal combustion engine according to the invention.

FIG. 14 shows a second embodiment of the ignition system for an internal combustion engine according to the invention. In this embodiment, a primary current control section 20 is provided in lieu of the ignition system diagnosing unit 10 in the previous embodiment of FIG. 4. In other words, this embodiment is the same as the embodiment of FIG. 4 except for that the primary current control section 20 controls the igniter 2 for on-off controlling the primary current in the ignition coil and that the ignition coil 1' in this case is of an improved type with the current therein increasing linearly with time as shown by a solid line or dashed line in FIG. 15.

The primary current control section 20 is a gist of this embodiment, and it determines the energization period of the primary of the coil 1 from the magnitude of the floating capacitance and controls the energy supplied to the coil without varying the ignition timing but by varying the timing of the commencement of the conduction.

Figure 1:
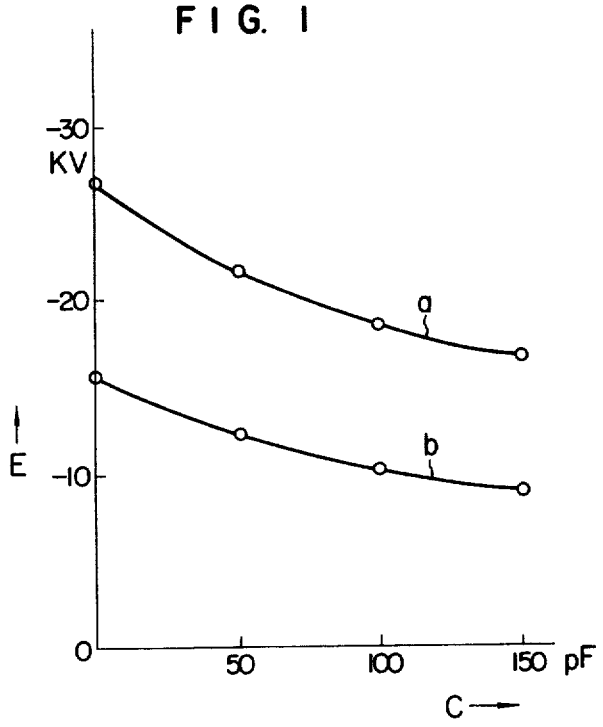
FIG. 1 is a graph showing the way in which the maximum value of the voltage produced in an ignition coil is reduced with increasing floating capacitance.
Figure 2:
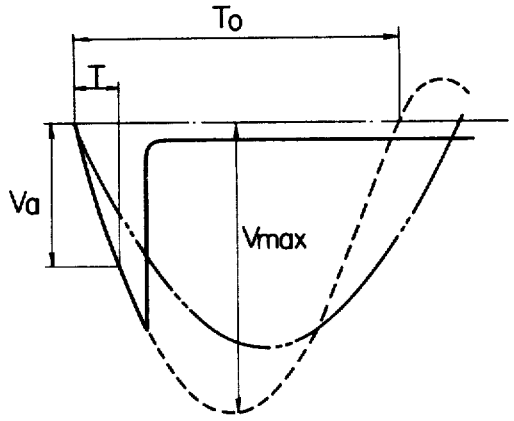
FIG. 2 is a waveform chart showing the ignition coil secondary voltage.
Figure 16:
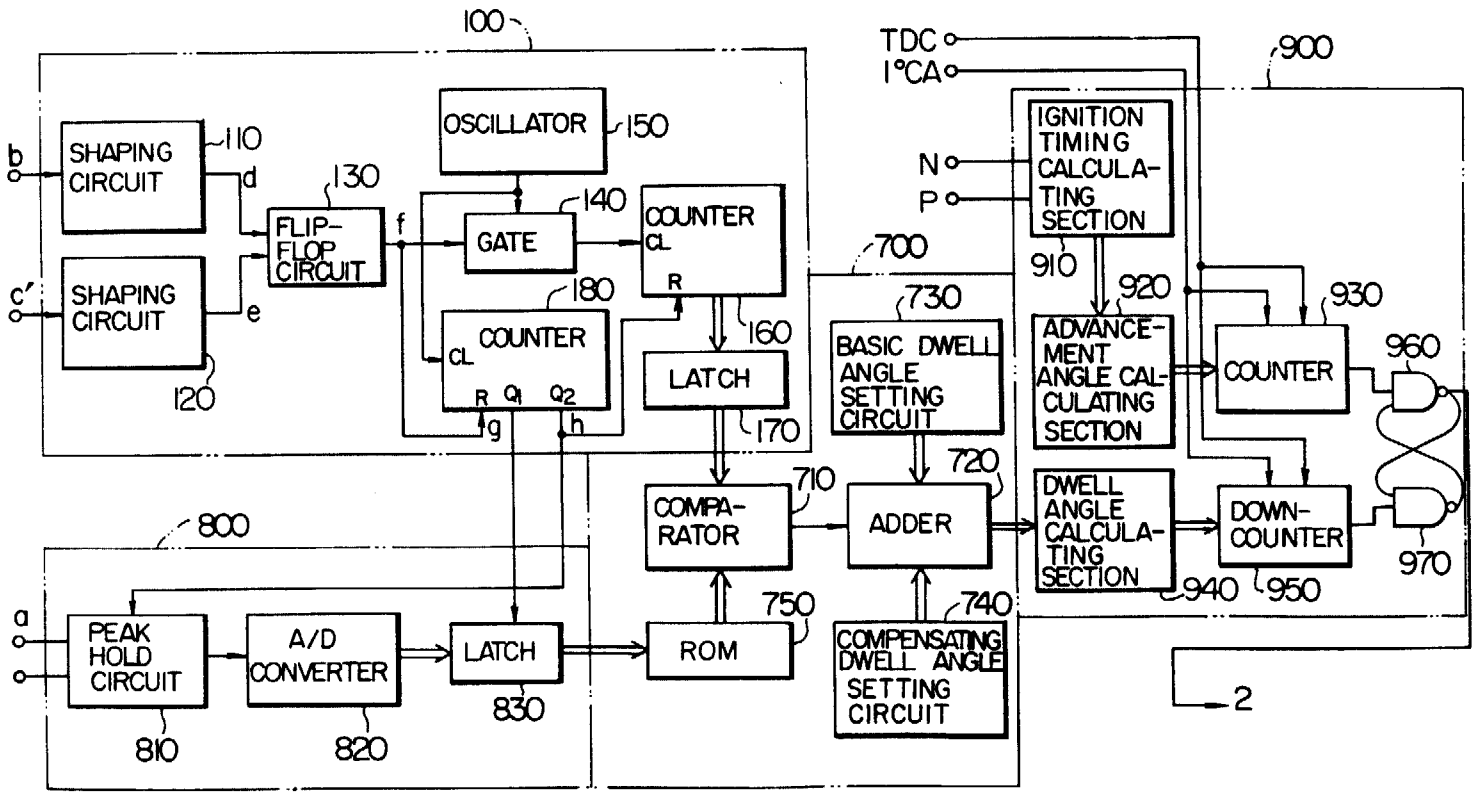
FIG. 16 is a block diagram showing an example of a component part of the embodiment of FIG. 14.
Figure 17:
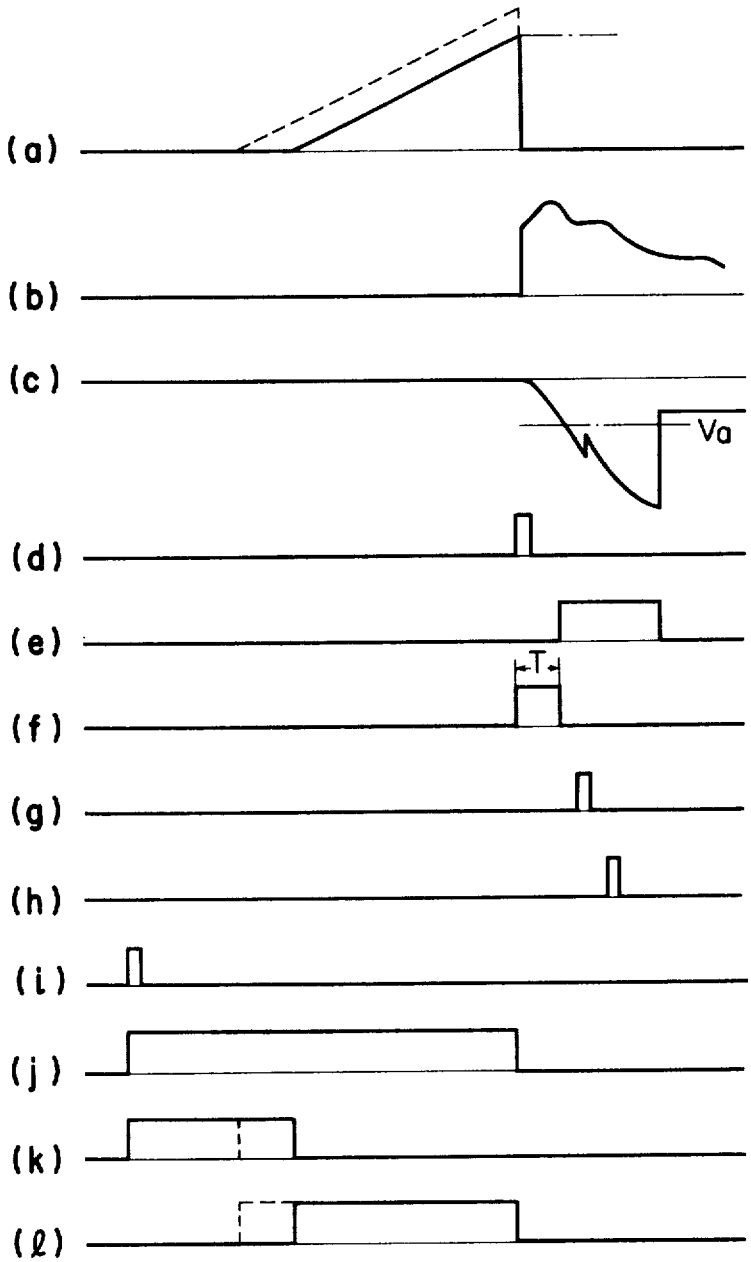
FIG. 17 is a time chart illustrating the operation of the circuit of FIG. 16.

Now, the primary current control section 20 will be described. FIG. 16 shows its block diagram, and FIG. 17 is a time chart illustrating its operation. In FIG. 16, designated at 100 is a floating capacitance detecting section. Its input terminals b and c' are connected to the respective points b and c' in FIG. 14, and waveforms as shown in (b) and (c) in FIG. 17 appear at the respective points b and c'. The floating capacitance detecting section 100 shown in FIG. 16 is the same as the floating capacitance detecting section 100, so its detailed description is omitted. The waveforms of the outputs of the shaping circuits 110 and 120 in the floating capacitance detecting section 100 in FIG. 16 are respectively shown in (d) and (e) in FIG. 17. Also, the output waveform of the flip-flop circuit 130 is shown in (f) in FIG. 17, and the output waveform of the counter 180 is shown in (g) and (h) in FIG. 17. The measurement value T obtained by measuring the period T shown in FIG. 2 is latched in the latch 170 and is supplied to an energization period control section 700. The value T here represents the period until the secondary voltage across the ignition coil 1 reaches a constant voltage $V_2$, i.e., the slope of rising of the secondary voltage. Designated at 800 is a primary cutoff current measuring section. It detects the primary current from the potential difference between the opposite terminals of the external resistor 7 in series with the primary coil. A peak hold circuit 810 holds the peak of the potential difference between the opposite ends of the resistor 7 (of a waveform as shown by a solid line in (a) in FIG. 17), and an A/D converter 820 converts this value into a digital value. A latch 830 takes out this digital value under the control of the afore-mentioned latch signal as shown in (g) in FIG. 17 and supplies it to a ROM 750 in the control section 700. The content of the program stored in the ROM 750 is, for instance, as shown by the plot c for a floating capacitance value of 100 pF as shown in the graph of FIG. 3. When the primary cutoff current is 3 A and the rising period T is 34 μsec., a point on the plot c is taken out, showing that the floating capacitance is increased by 100 pF. As the content of the ROM 750, the rising period, for instance one corresponding to the plot for the floating capacitance value of 100 pF, is memorized as a corresponding count number of clock pulses produced from the oscillator 150. The peak hold circuit 810 is reset by the afore-mentioned period control signal as shown in (h) in FIG. 17.

A comparator 710 in the energization period control section 700 compares the output of the latch 170, i.e., the measured rising period, and the output of the ROM 750, i.e., the rising period corresponding to a predetermined primary cutoff current value for the floating capacitance value of 100 pF, and it produces an output of a level "1" when the former is longer than the latter. At this time, in an adder 720 a basic dwell angle ($K_1$) which is always provided from a basic dwell angle setting circuit 730 and a compensating dwell angle ($K_2$) provided from an angle setting circuit 740 are added together to produce a dwell angle ($K_1+K_2$). Normally, (i.e., when the output of the comparator 710 is at a level "0"), the sole basic dwell angle ($K_1$) from the basic dwell angle setting circuit 730 is provided from the adder 220. Designated at 900 is an ignition timing control section for determining the energization commencement timing and ignition timing. In this section, an ignition timing calculating section 920 calculates the ignition timing from a r.p.m. value N and an intake pressure value P supplied to it, and an advancement angle calculating section 940 produces from a top dead center signal (TDC) as shown in (i) in FIG. 17 a crank angle signal as shown in (j) in FIG. 3. A down-counter 430 down-counts this value for each one-degree crank angle signal (1° CA).

Meanwhile, a dwell angle calculating section 940 produces a dwell angle signal as shown in (k) in FIG. 17, and a down-counter 950 down-counts this value for each one-degree crank angle signal (1° CA). When the outputs of the counters 930 and 940 become zero, a signal is supplied to a flip-flop circuit of a well-known construction constituted by NAND circuits 960 and 970, and the energization commencement timing and ignition timing are controlled by the output signal from this flip-flop as shown in (l) in FIG. 17. Thus, when the floating capacitance is increased, the energization period can be increased to increase the coil energy without changing the ignition timing, as shown by a dashed line in (l) in FIG. 17. The normal energization period is indicated by a solid line in (l) in FIG. 17. By providing a longer period for energizing the coil primary the primary cutoff current $I_{off}$ can be increased from the value shown by the solid line in FIG. 15 to the value of the dashed line to increase the coil energy. The one-degree crank angle signal (1° CA) and top dead signal (TDC) are provided from a signal generator, which comprises a slit disc installed on the engine crankshaft and a photosensor for detecting the slit.

Figure 18:
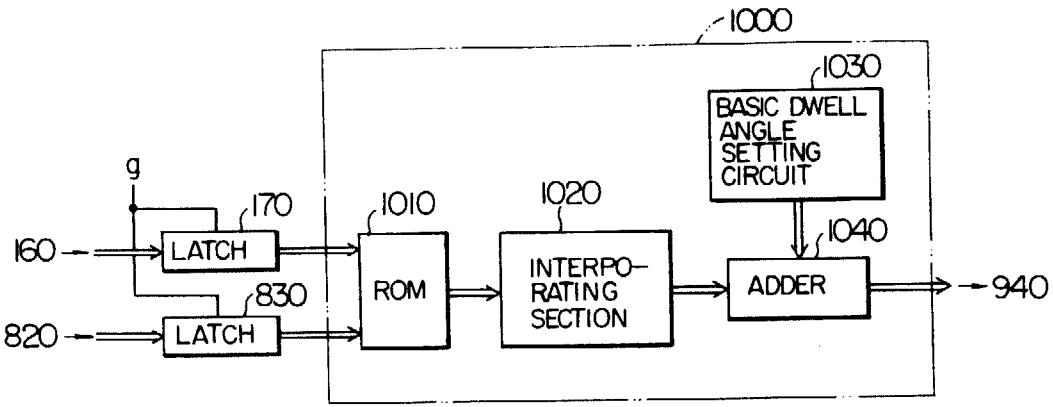
FIG. 18 is a block diagram showing a second example of the component part of the embodiment of FIG. 14.

A second example of the primary current control section 20 will now be described. While in the preceding first example the energization period is controlled such that when the floating capacitance exceeds a predetermined value the energization period is made longer by an extent corresponding to a predetermined crank angle, in the second embodiment the energization period is continuously controlled according to the floating capacitance value. FIG. 18 shows a portion of the second example that sets this example apart from the first example; namely an energization period control section 1000 corresponding to the section 700 shown in FIG. 16. In FIG. 18, a latch 170 corresponds to the latch 170 in FIG. 16, and when the pulse signal shown in (g) in FIG. 17 is produced it supplies the count number corresponding to the rising period T until the reaching of the constant voltage $V_a$ by the secondary voltage, obtained in the preceding stage circuit, to a ROM 1010. A latch circuit 830 corresponds to the latch circuit 830 in FIG. 2, and it supplies the primary cutoff current derived in the preceding stage circuit to the ROM 1010 under the control of the pulse signal shown in (g) in FIG. 6. In the ROM 1010, data concerning the compensation angle which is determined as a function of the floating capacitance which is in turn determined from the rising period T and primary cutoff current $I_{off}$ and to be added to the basic dwell angle are memorized. This compensation angle increases with increasing floating capacitance to increase the energization period and hence the coil energy. Table below shows an example of the memory content of the ROM 1010. The compensation angle memorized in this example is, for instance, 1.0° for 20 μsec. as the value of T, 7.0° for 30 μsec., 14.0° for 40 μsec. and so forth with 3.0 A as the value of $I_{off}$. Values within parentheses given below these compensation angle values represent the corresponding floating capacitance.

| | T | | | | |
|---|---|---|---|---|---|
| $I_{off}$ | 20 | 30 | 40 | 50 | 60 |
| 2.0 | | 3.5 | 7.0 | 9.5 | 14.0 |
| | | (35) | (70) | (95) | (140) |
| 2.5 | 0 | 5.0 | 10.0 | 15.0 | |
| | (−5) | (50) | (100) | (150) | |
| 3.0 | 1.0 | 7.0 | 14.0 | 20.0 | |
| | (10) | (70) | (140) | (200) | |
| 3.5 | 1.5 | 9.0 | 17.0 | | |
| | (15) | (90) | (170) | | |
| 4.0 | 1.5 | 100 | 19.0 | | |
| | (15) | (100) | (190) | | |

In an interporating section 1020, the compensation dwell angle is determined, in an adder 1040 and the compensation dwell angle is added to the basic dwell angle from a basic dwell angle setting circuit 1030 to produce the dwell angle output supplied to the dwell calculating section 940. As an example, when the rising period T is 35 μsec. and the primary cutoff current $I_{off}$ is 3 A, the compensation angle is obtained from 14° C. for T=40 μsec. with $I_{off}$=3A and 7° for T=30 μsec. with $I_{off}$=3A by the interpolation method, and is 10.5° (the corresponding floating capacitance being 105 pF). In this case, the output dwell angle specified by the adder 1040 is greater than the basic dwell angle by 10.5°, and the coil energy is increased by the corresponding amount.

Figure 19:
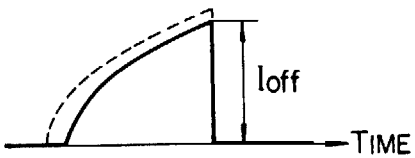
FIG. 19 is a waveform chart showing the primary current in the usual ignition coil.
Figure 15:
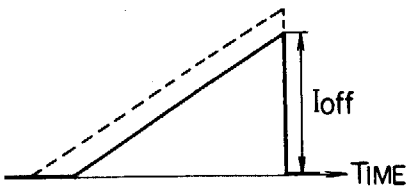
FIG. 15 is a waveform chart showing the primary current in the ignition coil used in the system according to the invention.

While in the above embodiments the voltage division ratio of the voltage divider 9 is set to 1/1000, this is by no means limitative. Also, the ignition coil 1 is not limited to the one, in which the current increases linearly with time as shown in FIG. 15, and it is possible to use as well an ordinary coil in which the current varies in a manner as shown in FIG. 19. In FIG. 19, a solid curve shows the waveform of the current normally caused, and a dashed curve of the current that is caused when the energization period is increased.

Figure 20:
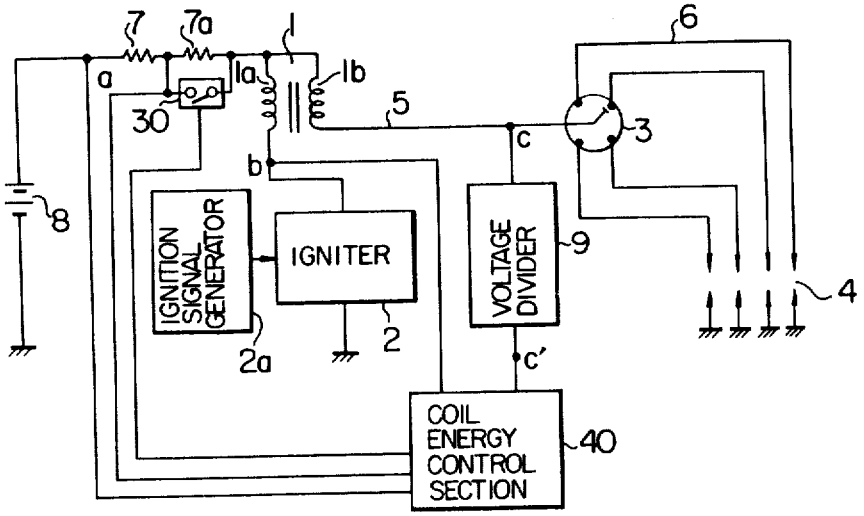
FIG. 20 is a schematic showing a third embodiment of the ignition system for an internal combustion engine according to the invention.

FIG. 20 shows a third embodiment of the ignition system for an internal combustion engine according to the invention. In the embodiment of FIG. 20, unlike the embodiment of FIG. 14 in which the igniter 2 is controlled by the primary current control section 20, the igniter 2 is on-off controlled by an ignition signal from an ignition signal generating means 2a for controlling the energization of the primary coil 1a of the ignition coil 1 to produce a high voltage across the secondary coil 1b therein. External resistors 7 and 7a are connected in series with the primary coil 1a of the ignition coil 1, and as a primary current control circuit a relay 30 is connected in parallel with the resistor 7a. The relay 30 is controlled by a coil energy control section 40, which is a gist of the invention such that the resistor 7a is shunted when an output of a level "1" is produced from the control section 40. The ignition coil 1 is an ordinary ignition coil, that is, it is not of the improved type with the current linearly increasing with time as shown in FIG. 14. In the other construction, the embodiment of FIG. 20 is the same as the embodiment of FIG. 14.

Figure 21:
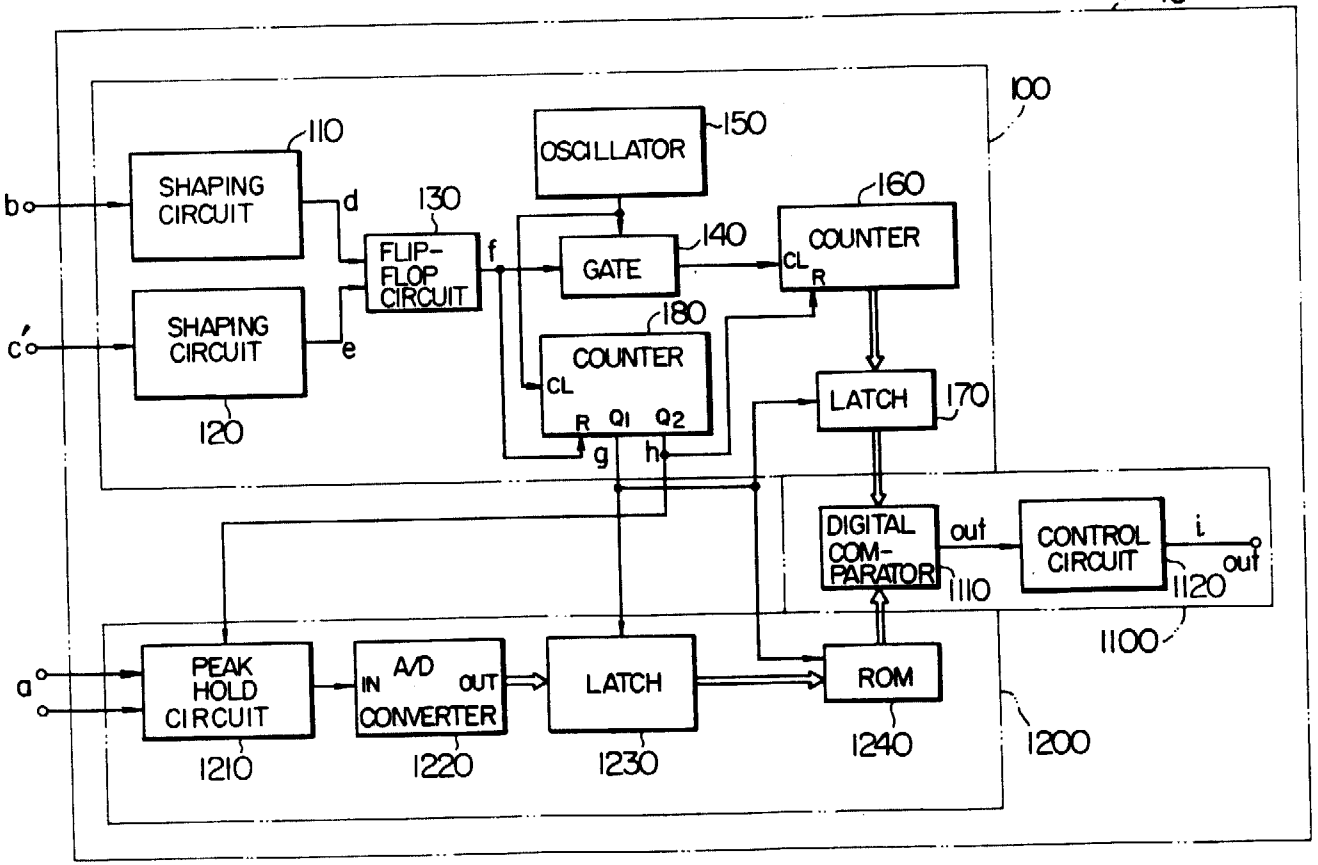
FIG. 21 is a block diagram showing an example of a component part of the embodiment of FIG. 20.
Figure 22:
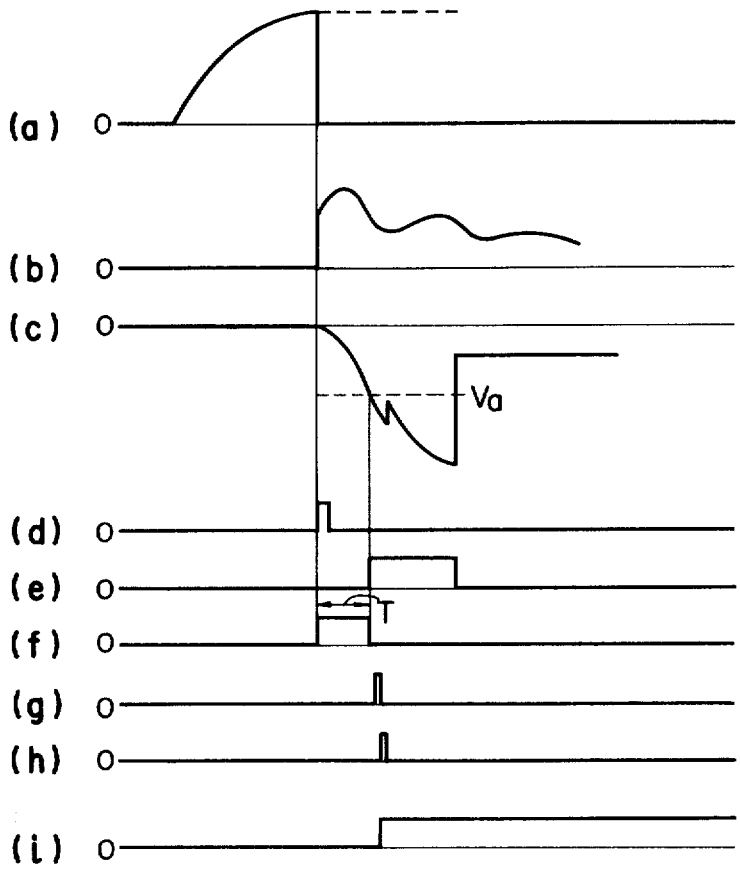
FIG. 22 is a time chart illustrating the operation of the circuit of FIG. 21.

An example of the coil energy control section 40 will now be described. FIG. 21 is its block diagram, and FIG. 22 is a time charge illustrating the operation of it. In FIG. 21, designated at 100 is a floating capacitance detecting section with its input terminals b and c' connected to the respective points b and c' in FIG. 20. Waveforms as shown in (b) and (c) in FIG. 22 appear in the respective points b and c'. The construction of the floating capacitance detecting section 100 in FIG. 21 is the same as that of the section 100 in FIG. 5, so its detailed description is omitted here. The waveforms of the outputs of the shaping circuits 110 and 120 are respectively shown in (d) and (e) in FIG. 17. Also, the waveform of the output of the flip-flop circuit 130 is shown in (f) in FIG. 17, and the waveform of the output of the counter 180 is shown in (g) and (h) in FIG. 17. The measurement value T obtained by measuring the period T in FIG. 2 is latched in the latch 170 and supplied to a comparator section 1100.

Figure 23:
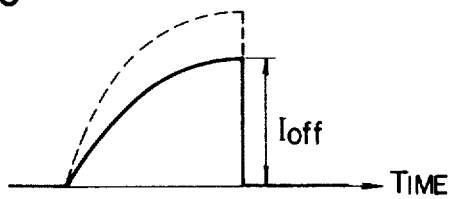
FIG. 23 is a waveform chart showing the ignition coil primary current.

Designated at 1200 is a level setting section, in which the primary current is detected from the potential difference between the opposite terminals of the external resistor 7 in series with the primary coil. A peak hold circuit 310 holds the peak of the potential difference between the opposite terminals of the resistor 7 (the waveform as shown by a solid curve in (a) in FIG. 22) as shown by a dashed line in (a) in FIG. 22. The peak hold circuit 1210, an A/D converter 1220, a latch 1230 and a ROM 1240 in the level setting section 1200 are respectively the same in construction, connection and operation as the peak hold circuit 810, A/D converter 820 and latch 830 in the primary cutoff current section 800 and the ROM 750 in the energization period control section 700 in FIG. 16, so their detailed description is omitted here. The comparator section 1100 includes a digital comparator 1110, which compares the output of the latch 170, i.e., the period of rising of the secondary voltage, and the output of the ROM 1240, and a control circuit 1120 for controlling the relay 30 according to the output of the digital comparator 1110. When the measured rising period T is longer the rising period corresponding to a predetermined primary cutoff current for the floating capacitance value of 100 pF, the comparator 1110 produces an output of a level "1" showing that the floating capacitance is increased. The control circuit 1120 amplifies this signal up to a level capable of operating the relay 30 so that the relay 30 is turned "on". As a result, the total resistance on the primary side of the ignition coil 1 is reduced to increase the primary cutoff current $I_{off}$ as shown in FIG. 23 so as to increase the coil energy. Thus, the secondary voltage produced in the ignition coil 1 is increased to prevent the generation of a miss-spark.

A second example of the coil energy control section 40 will now be described. While in the preceding example the period T until the secondary voltage reaches a constant value $V_2$ has been measured for determining the slope of rising of the secondary voltage, in this example the slope is determined by obtaining the secondary voltage after the lapse of a predetermined period of time.

Figure 24:
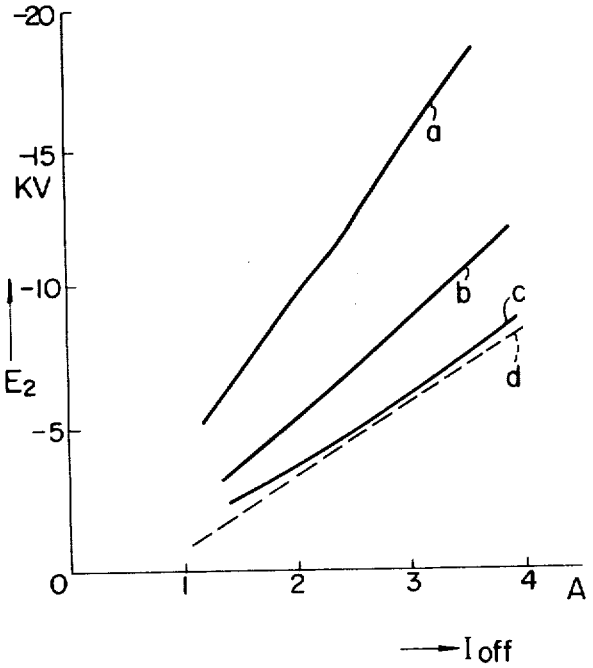
FIG. 24 is a graph showing a relationship among the primary cutoff current, the secondary voltage at a predetermined instant and the floating capacitance.

FIG. 24 shows, similar to FIG. 7, the secondary voltage $E_2$ 50 μsec. after the rising of the primary voltage. Plots a, b and c represent characteristics for respective floating capacitance values of 0, 50 and 100 pF. The floating capacitance can be determined from the secondary voltage $E_2$ and primary cutoff current $I_{off}$ with reference to this Figure. When the measured secondary voltage is found to be lower than the value in the graph for, for instance, the floating capacitance value of 100 pF, the resistance on the primary side of the ignition coil 1 (resistance of a circuit including the external resistors 7 and 7*a* in series) is reduced.

Figure 25:
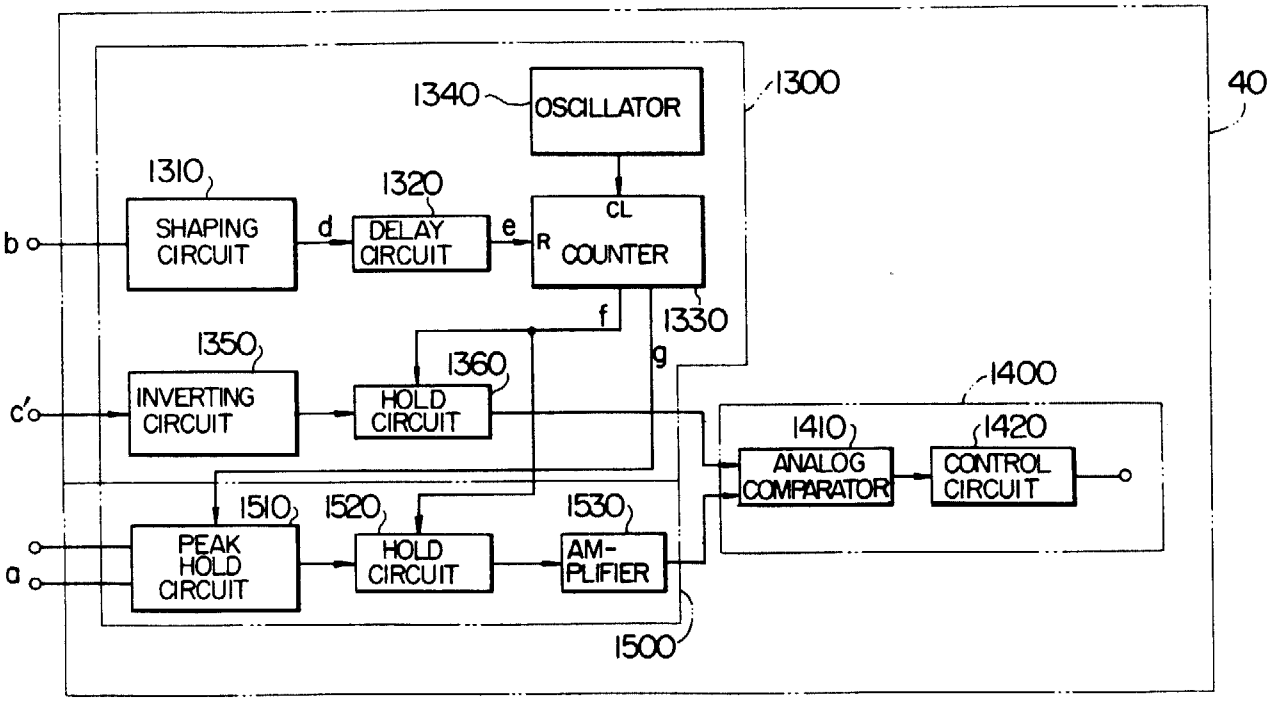
FIG. 25 is a block diagram showing a second example of the component part of the embodiment of FIG. 20.
Figure 26:
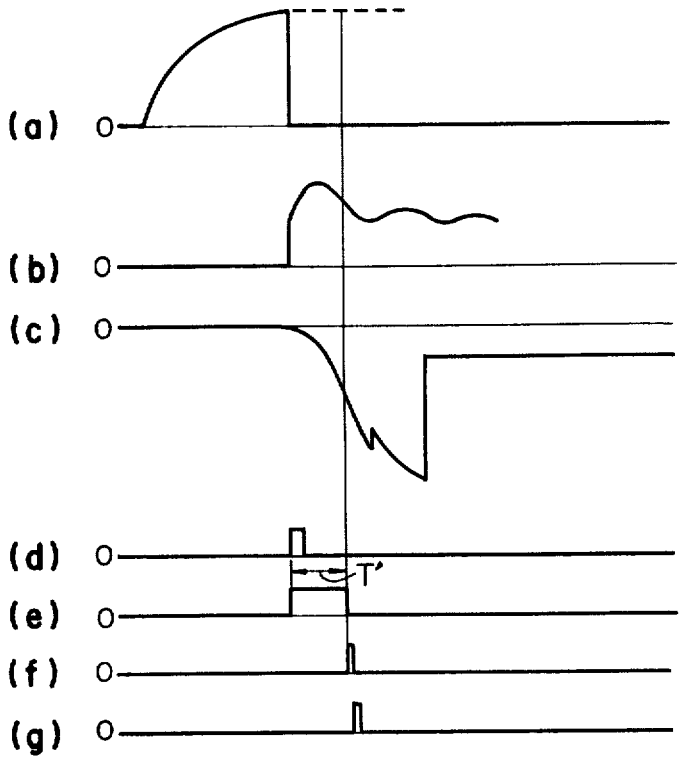
FIG. 26 is a time chart illustrating the operation of the circuit of FIG. 25.

FIG. 25 shows the second example of the coil energy control section 40, and FIG. 26 is a time chart illustrating the operation of it. Designated at 1300 is a floating capacitance detecting section. It includes a shaping circuit 1310 with the input terminal thereof connected to the point b in FIG. 4, i.e., the juncture between the ignition coil 1 and igniter 2. At this point b appears a waveform as shown in (b) in FIG. 26 similar to the waveform shown in (b) in FIG. 22. The shaping circuit 1310 converts this waveform into a pulse as shown in (d) in FIG. 26. A delay circuit 1320 produces a pulse as shown in (e) in FIG. 26, having a duration T' from the rising of the pulse in (d) in FIG. 26. A counter 1330 counts clock pulses from an oscillator 1340 and produces a pulse as shown in (f) in FIG. 26 immediately after the duration T' of the pulse in (e) in FIG. 26.

Figure 27:
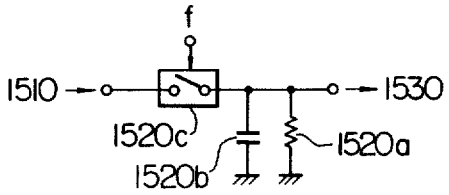
FIG. 27 is a circuit diagram showing a hold circuit in the circuit of FIG. 25.

The section 1300 further includes an inverting circuit 1350 with the input terminal thereof connected to the output terminal of the voltage divider 9 and receiving a waveform as shown in (c) in FIG. 26. This waveform is a negative voltage, and an inverting circuit 1350 inverts this voltage into a positive one. A hold circuit 1360 samples and holds the output of the inverting circuit 1350 at the timing of the output of the counter 1330 (i.e., the pulse shown in (f) in FIG. 26). Designated at 1500 is a level setting section. It detects the primary current from the potential difference between the opposite terminals of the external resistor 7 in series with the primary coil 1. A peak hold circuit 1510 holds the peak of the potential difference between the opposite terminals of the resistor 7 (i.e., a waveform as shown in (a) in FIG. 26), and a hold circuit 1520 also effects sampling and holding at the timing of the output of the counter 1330 as shown in (f) in FIG. 26. The hold circuit 1520 has a construction as shown in FIG. 27. Its time constant is suitably set by appropriately selecting the resistance of its resistor **1520*a* and the capacitance of its capacitor 1520*b* so that a change of $I_{off}$ can be detected. It further has an analog switch 1520*c* which is turned on when the signal shown in (f) in FIG. 26** is at level "1".

The section 1500 further includes an amplifier 1530. It produces an output as a function of the sampled value of the primary cutoff current $I_{off}$, for instance as shown by a dashed plot d in FIG. 24. While the scale of the ordinate of the graph of FIG. 24 is in the order of kV, the actual scale is one-thousandth of the scale of the graph because of the fact that the voltage divider 9 is used. While in the preceding example the rising period programmed with $I_{off}$ for 100 pF is memorized in the ROM, in this example an approximation to the divided secondary voltage characteristic for 100 pF, i.e., the dashed plot in FIG. 24, is used. The program of this characteristic may of course be memorized by using a ROM as in the preceding example.

Designated at 1400 is a comparator section. It includes an analog comparator 1410 and a control circuit 1420 for controlling the relay 30 according to the output of the comparator 1410. The comparator 1410 compares its two inputs, i.e., the value obtained by sampling the divided secondary voltage a predetermined period of time T' after the rising of the primary voltage and a predetermined voltage value programmed with the primary cutoff current $I_{off}$ for the floating capacitance value of substantially 100 pF, and when the former becomes lower than the latter it produces an output at a level "1", whereby the relay 30 is turned "on" by the control circuit 1420.

The peak hold circuit 1510 is reset when a pulse shown in (g) in FIG. 26, slightly delayed after the pulse in (f) in FIG. 26, is produced from the counter 1330. While the voltage division ratio of the voltage divider 9 is set to 1/1000, this is by no means limitative, and any suitable ratio may be selected by considering the source voltage for the circuit and the amplification degree of the amplifier 1530.

Figure 28:
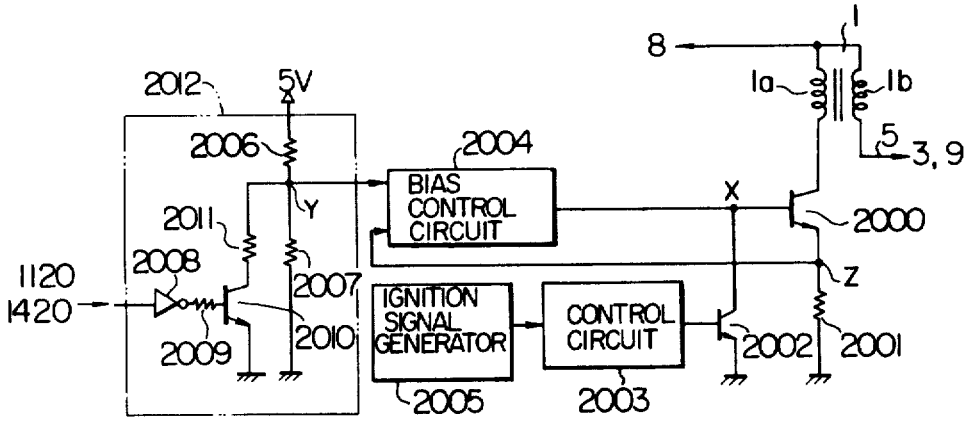
FIG. 28 is a circuit diagram showing a third example of the component part of the embodiment of FIG. 28.

FIG. 28 shows a third example of the coil energy control section 40. Designated at 2000 is a power transistor for controlling the energization of the ignition coil 1, and at 2001 a detecting resistor for detecting the primary current in the ignition coil 1. Designated at 2004 is a bias control circuit for controlling the base current in the transistor 2000. Designated at 2002 is a transistor for on-off controlling the power transistor 2000 and controlled by a control circuit 2003. The control circuit 2003 receives as its input an ignition timing control and energization control signal produced from a well-known ignition signal generating means 2005. Thus, a signal as shown in (a) in FIG. 29 appears at a point X in FIG. 28. Resistors 2006, 2007, 2009 and 2011, a transistor 2010 and an inverter 2008 constitute a level switching circuit 2012, and the potential at a point Y is changed by the signal from the control circuit 1120 shown in FIG. 21 or control circuit 1420 shown in FIG. 25.

Figure 29:
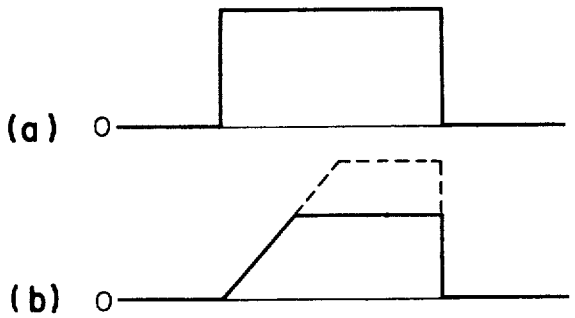
FIG. 29 is a time chart illustrating the operation of the circuit of FIG. 28.

When the energization of the primary coil **1*a* of the ignition coil 1 is started with the triggering of the power transistor 2000, the potential at a point Z, i.e., one end of the detecting resistor 2001, increases with current therethrough as shown in (b) in FIG. 29**.

The bias control circuit 2004 compares the potential at the point Z and a predetermined potential at the point Y, and when the potential at the point Z is higher than that at the point Y it functions to reduce the potential at the point X for reducing the base current in the transistor 2000. As a result, the operation of the transistor 2000 is controlled toward the cutoff, whereby the primary current is reduced to reduce the potential at the point Z. Consequently, the potential at the point Y becomes higher than the potential at the point Z, whereby the base current in the power transistor 2000 is increased to bring the power transistor again toward the conduction. In this way, during the energization of the primary coil the power transistor 2000 is controlled to make the potential at the point Z equal to that at the point Y, and thus the primary current in the ignition coil 1 trimmed at a certain value as shown in (b) in FIG. 29. In this construction, when the floating capacitance is less than a predetermined value (for instance 100 pF), at which time the output of the control circuit 1120 or 1420 is "0", the transistor 2010 is "on". Thus, at this time the potential at the point Y is at a low level, and the primary current which is controlled to a constant value is at a low level as shown by a solid line in (b) in FIG. 29.

When the floating capacitance is increased, the output of the control circuit 1120 or 1420 is changed to "1". As a result, the transistor 2010 is cutoff, increasing the potential level at the point Y, whereby the primary current is controlled to a high level as shown by a dashed line in (b) in FIG. 29 to increase the coil energy so as to increase the generated voltage for preventing the generation of a miss-spark.

While in the above embodiments the primary current is increased in a non-continuous way with the increase of the floating capacitance beyond a predetermined value, it is also possible to permit the primary current to be continuously increased with increasing floating resistance.

Also, while in the above embodiments the floating capacitance has been digitally calculated by using a floating capacitance calculating circuit constituted by a memory section using a ROM, it is also possible to calculate the floating capacitance analog-wise with a floating capacitance calculating circuit using a function generator circuit or the like.

What is claimed is:

1. An ignition system for an internal ignition engine comprising a secondary voltage rising slope measuring circuit for measuring the slope of rising of the secondary voltage produced in an ignition coil, a primary cutoff current measuring circuit for measuring the primary current in the primary coil of said ignition coil immediately before said primary current is cutoff, and a calculating circuit for producing an output representing the floating capacitance present in the ignition system from said slope measured by said secondary voltage rising slope and said primary cutoff current measured by said primary cutoff current measuring circuit and for producing an output representing the secondary voltage.

2. An ignition system for an internal combustion engine according to claim 1, wherein said secondary voltage rising slope measuring circuit determines said slope of rising of the secondary voltage by measuring the period from the rising of the primary voltage in said ignition coil until the second voltage reaches a predetermined value.

3. An ignition system for an internal combustion engine according to claim 1, wherein said secondary voltage rising slope measuring circuit determines said slope of rising of the secondary voltage by measuring the secondary voltage at an instant after a predetermined period of time after the rising of the primary voltage in said ignition coil.

4. An ignition system for an internal combustion engine according to claim 1, 2 or 3, wherein said calculating circuit includes a memory circuit for reading out floating capacitance data memorized in advance in response to a digital signal input responsive to said slope measured by said secondary voltage rising slope measuring circuit and a digital signal input responsive to said primary cutoff current measured by said primary cutoff current measuring circuit, and wherein said secondary voltage rising slope measuring circuit determines said slope of rising of the secondary voltage from the time from the rising of the primary voltage produced in said ignition coil until the discharge breakdown takes place and the discharge breakdown voltage.

5. An ignition system for an internal combustion engine according to claim 1, 2 or 3, wherein said calculating circuit includes a memory circuit for reading out previously memorized values of the floating capacitance and maximum generated secondary voltage on receiving a digital signal corresponding to the slope measured by said secondary voltage rising slope measuring circuit and a digital signal corresponding to the primary cutoff current measured by said primary cutoff current measuring circuit.

6. An ignition system for an internal combustion engine according to claim 4, wherein said calculating circuit includes a memory circuit for reading out previously memorized values of the floating capacitance and maximum generated secondary voltage on receiving a digital signal corresponding to the slope measured by said secondary voltage rising slope measuring circuit and a digital signal corresponding to the primary cutoff current measured by said primary cutoff current measuring circuit.

7. An ignition system for an internal combustion engine according to claim 1, 2 or 3, wherein said calculating circuit calculates the values of the floating capacitance and maximum generated secondary voltage from predetermined formulas for calculation on receiving a digital signal corresponding to the slope measured by said secondary voltage rising slope measuring circuit and a digital signal corresponding to the primary cutoff current measured by said primary cutoff measuring circuit.

8. An ignition system for an internal combustion engine according to claim 4, wherein said calculating circuit calculates the values of the floating capacitance and maximum generated secondary voltage from predetermined formulas for calculation on receiving a digital signal corresponding to the slope measured by said secondary voltage rising slope measuring circuit and a digital signal corresponding to the primary cutoff current measured by said primary cutoff measuring circuit.

* * * * *